US008935903B2

(12) United States Patent
Leykamm et al.

(10) Patent No.: US 8,935,903 B2
(45) Date of Patent: Jan. 20, 2015

(54) CENTERING UNIT FOR ALIGNING AT LEAST TWO GROUPED VESSELS AND METHOD FOR ALIGNING TWO GROUPED VESSELS

(75) Inventors: Dieter Leykamm, Neutraubling (DE); Georg Gertlowski, Schierling (DE)

(73) Assignee: Krones AG, Neutraubling (DE)

( * ) Notice: Subject to any disclaimer, the term of this patent is extended or adjusted under 35 U.S.C. 154(b) by 983 days.

(21) Appl. No.: 12/543,633

(22) Filed: Aug. 19, 2009

(65) Prior Publication Data

US 2010/0058716 A1 Mar. 11, 2010

(30) Foreign Application Priority Data

Sep. 9, 2008 (DE) ..... 10 2008 046 366

(51) Int. Cl.

| | |
|---|---|
| ***B65B 35/56*** | (2006.01) |
| ***B65C 3/16*** | (2006.01) |
| ***B65B 21/24*** | (2006.01) |
| ***B65B 27/04*** | (2006.01) |
| ***B65B 35/46*** | (2006.01) |
| ***B65B 35/54*** | (2006.01) |
| ***B65C 9/06*** | (2006.01) |
| ***B65C 9/18*** | (2006.01) |

(52) U.S. Cl.

CPC ..... *B65C 3/163* (2013.01); *B65B 21/245* (2013.01); *B65B 27/04* (2013.01); *B65B 35/46* (2013.01); *B65B 35/54* (2013.01); *B65C 9/065* (2013.01); *B65C 9/1819* (2013.01)

USPC ..... 53/446; 53/111 R; 53/544

(58) Field of Classification Search

CPC ..... B65B 21/245; B65B 27/04; B65B 35/56; B65C 3/163; B65C 9/065

USPC ..... 53/331.5, 317, 331, 446, 147, 158, 544

See application file for complete search history.

(56) References Cited

U.S. PATENT DOCUMENTS

| | | | | |
|---|---|---|---|---|
| 5,290,388 | A * | 3/1994 | Zepf | 156/447 |
| 5,301,725 | A * | 4/1994 | Meinzinger | 141/372 |
| 6,708,470 | B2 * | 3/2004 | Eiban et al. | 53/585 |

FOREIGN PATENT DOCUMENTS

| | | |
|---|---|---|
| DE | 1269029 | 5/1968 |
| DE | 7011451 | 7/1970 |
| DE | 3025178 | 1/1982 |
| DE | 4025410 C1 | 9/1991 |
| DE | 4114025 | 11/1992 |
| DE | 19716262 | 10/1998 |
| DE | 20102782 | 5/2001 |

(Continued)

OTHER PUBLICATIONS

European Search Report for EP 09166991.1 dated Jan. 5, 2010.

(Continued)

*Primary Examiner* — Andrew M Tecco

(74) *Attorney, Agent, or Firm* — Marshall, Gerstein & Borun LLP

(57) ABSTRACT

A centering unit for aligning at least two grouped vessels, a liftable and lowerable precentering mechanism as well as a liftable and lowerable final centering mechanism being provided so as to improve the alignment. According to a preferred embodiment, the precentering mechanism may include a plurality of subcentering mechanism so that vessels coming from different infeeds can be centered by mechanism a centering unit.

19 Claims, 6 Drawing Sheets

(56) References Cited

FOREIGN PATENT DOCUMENTS

| | | |
|---|---|---|
| DE | 20010837 | 7/2001 |
| DE | 20114368 | 10/2002 |
| EP | 1495973 A1 | 1/2005 |

OTHER PUBLICATIONS

German Search Report for 10 2008 046 366.3.

Chinese Office Action for Application No. 200910173706.7, dated Feb. 23, 2012.

* cited by examiner

CENTERING UNIT FOR ALIGNING AT LEAST TWO GROUPED VESSELS AND METHOD FOR ALIGNING TWO GROUPED VESSELS

CROSS-REFERENCE TO RELATED APPLICATION

The present application claims the benefit of priority of German Patent Application No. 102008046366.3, filed Sep. 9, 2008. The entire text of the priority application is incorporated herein by reference in its entirety.

FIELD OF THE DISCLOSURE

The present disclosure relates to a centering unit for aligning at least two grouped vessels relative to one another as well as a machine for treating such vessels and a method for aligning at least two grouped vessels.

BACKGROUND

Such a device is known from DE 201 14 368 U1. This reference describes a device for wrapping a label around at least two parallel juxtaposed objects, said label being common to all the objects and tying them into a bundle. To this end, two respective vessels are arranged in common on a rotary plate and are then both wrapped with a single label, instead of moving only one object on a rotary plate past a labeler, as is normally the case in conventional labelling machines. In order to maintain the two vessels in correct alignment with one another during the labelling process, the two vessels are axially fixed with respect to the rotary table with the aid of a centering bell.

The known machine proved to be disadvantageous insofar as, in spite of the centering bell, it was often difficult to axially fix the vessels. In addition, the device lacks flexibility as regards the labelling of more than two vessels.

SUMMARY OF THE DISCLOSURE

It is therefore an aspect of the present invention to allow improved centering of the device described.

This aspect is achieved by the centering unit for aligning at least two grouped vessels. The centering unit for aligning at least two grouped vessels relative to one another comprises a liftable and lowerable precentering means and a liftable and lowerable final centering means. Thanks to the precentering means, the grouped vessels can be aligned more precisely relative to one another and can then be secured at their final position by the final centering means. In addition, due to the provision of two centering means, the vessels are aligned relative to one another and held at two different levels, whereby the stability of the alignment relative to one another will be improved still further.

According to a preferred embodiment, the precentering means can comprise a plurality of subcentering means that can be lifted and lowered individually. Due to the fact that a plurality of subcentering means is provided, the centering means can be adapted to the number of grouped vessels in a flexible manner. In particular, it is possible to form the group of a plurality of subgroups and/or individual vessels and, thanks to the fact that the subcentering means can be lifted and lowered individually, the subgroups can be aligned relative to one another step by step.

According to a preferred embodiment, the precentering means and the final centering means can be implemented such that they can be lifted and lowered independently of one another. Especially in connection with the subcentering means, it is thus possible to execute final centering only when all the subgroups have been aligned relative to one another so as to finally secure the vessels in position.

According to a preferred embodiment, the precentering means, in particular the subcentering means, can be implemented such that they can be lifted and lowered via a pneumatic control. For example, the centering process, in particular the centering process for the subcentering means, can be triggered via a recessed control track and a pneumatic valve.

A preferred embodiment can be so conceived that the subcentering means are each provided with at least one vessel reception opening. The number of vessel reception openings is adapted to the number of vessels comprised in the subgroups. A vessel reception opening which is implemented as a through hole has the advantage that the subcentering means cannot only be used for precentering the vessel extremities but can also be pushed onto the necks of the vessels so that the positioning of the vessels relative to one another can be stabilized still further.

According to a preferred embodiment, the lifting and lowering paths of the vessel reception openings of the precentering means and of the final centering means can be formed coaxially with one another. This allows structural simplifications, since e.g. the stroke required for precentering can be realized, at least partially, from the stroke executed for final centering.

It will be advantageous when the precentering means comprises two or three subcentering means and when each subcentering means is provided with two vessel reception openings. Quadropacks or sixpacks which are very popular in the beverage industry can be dealt with by such precentering means.

The disclosure additionally relates to a machine for treating at least two grouped vessels, in particular for wrapping said vessels with a common label, comprising a treatment station, in particular a treatment station configured as carousel, said machine comprising at least one rotary plate for receiving thereon the vessels and at least one centering unit associated with a respective rotary plate. Thanks to the advantageous centering unit, the individual vessels of the group can be positioned precisely and reliably relative to one another.

According to a preferred embodiment, the machine can comprise at least one, in particular two or three vessel feeding devices for providing the vessels on the at least one rotary plate in the treatment station. Each vessel feeding device can have associated therewith a subcentering means of the centering unit used, so as to precenter the respective vessels fed by a vessel feeding device relative to one another and relative to the vessels of possibly existing other vessel feeding devices, independently of the other vessel feeding devices. The machine is thus rendered even more flexible.

In particular, different vessels—i.e. vessels which are different with respect to shape and/or content—can be fed via various vessel feeding devices, so that bundles that are interesting to the customer can be produced. Depending on the number of vessel feeding devices, e.g. twinpacks, quadropacks and also sixpacks can be dealt with.

According to an advantageous embodiment, a vessel feeding device can include a grouping device for providing vessel groups, in particular vessel pairs, in predetermined spaced relationship with one another. Hence, a vessel feeding device can be used for pushing not only one vessel, but a pair or a plurality of vessels into the treatment station. This increases the flexibility of the machine still further.

According to a preferred embodiment, the vessel feeding devices can comprise an infeed star wheel and an infeed worm. Due to the spatial separation of the grouping of the vessels and of their feeding into the treatment station, a particularly simple structural design of the machine is accomplished.

The disclosure also relates to a method of aligning at least two grouped vessels, preferably in a machine for treating vessels, even more preferably for wrapping the grouped vessels with a common label, the method comprising the following steps: a) precentering the grouped vessels with a liftable and lowerable precentering means, and b) final centering of the precentered vessels with a liftable and lowerable final centering means. This allows in particular the use of the centering unit in accordance with the various above-described embodiments. Thanks to the precentering, a particularly effective centering and axial fixing of the vessels will be accomplished, so that the position which said vessels occupy relative to one another will remain stable during the treatment.

According to a preferred embodiment, the vessels can be provided, in particular in pairs, by at least one, preferably two or three vessel feeding device(s). It is thus possible to treat products that are interesting to the customer, in particular twinpacks, quadropacks or sixpacks.

According to a preferred embodiment, the precentering means can comprises at least two subcentering means, and the method steps a), b) can comprise at least the following steps:
a1) precentering a first vessel group by lowering a first subcentering means, then
a2) precentering a second vessel group by lowering a second subcentering means, and then b1) final centering of the precentered vessels by lowering the final centering means.

Due to individual precentering, vessels which are provided by different vessel feeding devices can effectively be positioned relative to one another, so that, when all the vessels have been precentered, they can stably be held in position relative to one another through final centering. It goes without saying that the method described can comprise more than two vessel groups. Each vessel group can have associated therewith a subcentering means, said subcentering means being used before the final centering operation is carried out with the final centering means.

BRIEF DESCRIPTION OF THE DRAWINGS

Preferred embodiments of the present disclosure are now described with reference to the attached figures, in which.

DETAILED DESCRIPTION OF THE PREFERRED EMBODIMENT

Figure 1:
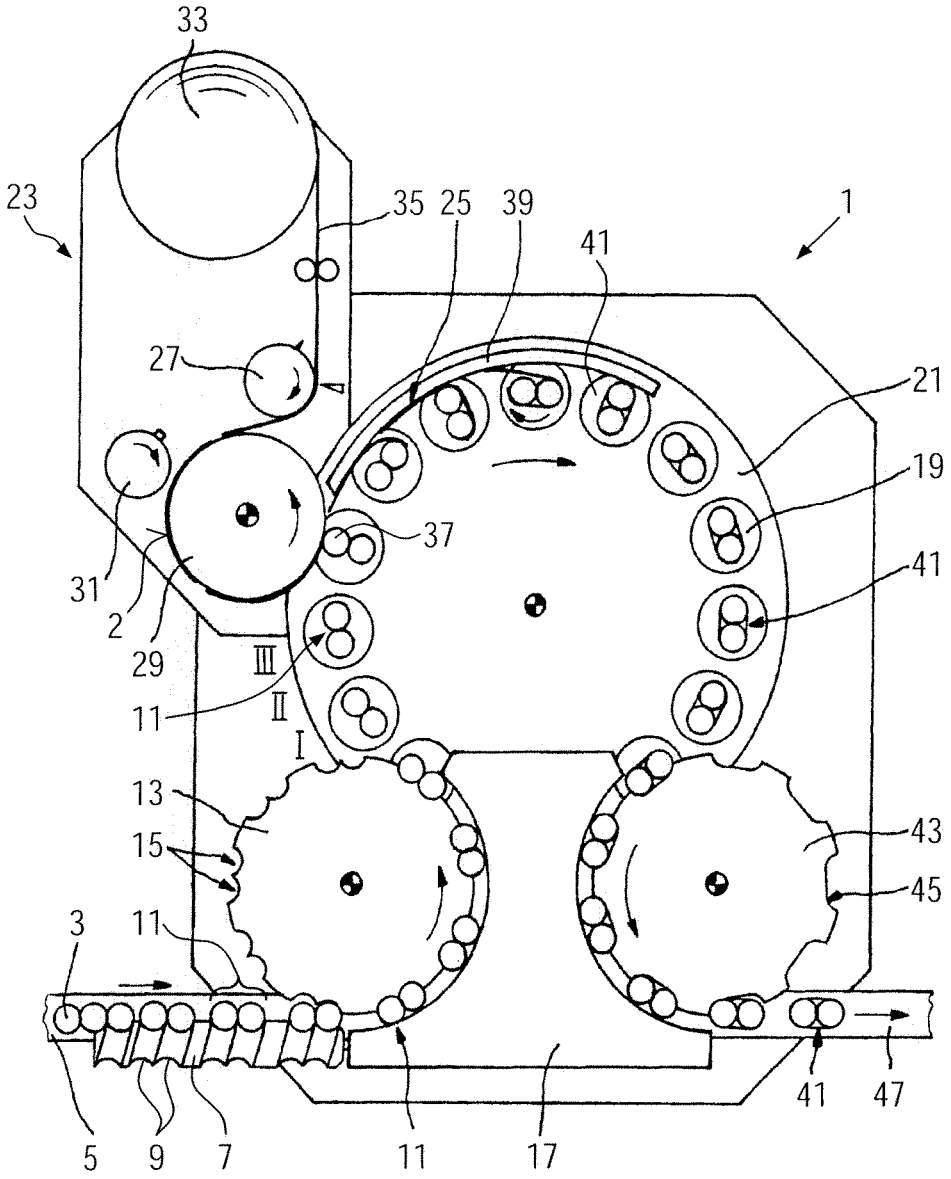
FIG. 1 shows a schematic overview of a device for enwrapping juxtaposed objects.

FIG. 1 shows a machine for treating at least two grouped vessels according to a first embodiment of the present disclosure. The machine shown is a labelling machine 1. Vessels 3, in particular bottles or the like, are supplied to the machine 1 via a conveyor belt 5. In the present embodiment, the vessels are grouped in pairs 11 via an infeed worm in 7—thanks to the pitch of the screw flights 9 which increases in the conveying direction—and adjusted to the pitch of the infeed star wheel 13, which follows the infeed worm 7 and which is driven synchronously therewith. The infeed star wheel 13 has circumferentially distributed reception pockets 15 to which the bottle pairs 11 are transferred. A guide arc 17 allows, together with the infeed star wheel 13, a transfer of the bottle pairs 11 to rotary plates 19 of a treatment station 21.

The treatment station 21, which is here provided in the form of a carousel, comprises a plurality of regularly spaced rotary plates 19 of this type. The rotary plates 19 and the carousel 21 are provided with drive units allowing a controlled rotation of the rotary plates 19 while the rotary plates are moving along their circular paths. The drive units used are e.g. program-controlled servo motors, stepping motors or mechanical control units.

The bottle pairs 11 are wrapped with a common label 25 with the aid of a labelling module 23. The labelling module 23 comprises a knife cylinder 27, a vacuum transfer cylinder 29 as well as a gluing roller 31 on the periphery of said vacuum transfer cylinder 29. A label strip 35, which is unwound from a label strip roll 33, is fed to a knife edge of the knife cylinder 27 and thus divided into individual labels 25. These individual labels 25 are then transferred to the vacuum transfer cylinder 29. By means of the gluing roller 31 glue is then applied e.g. to the leading front edge of the label as well as to the trailing rear edge of the label, the glue being in both cases applied to the back of the label. The labelling module 23 is driven such that it rotates in position- and speed-synchronism with the carousel 21. The labelling module 23 described should here be regarded as one possibility of attaching the labels, but without any restrictive effect; any other way of providing a label is possible as well.

When the group is travelling past the vacuum roller 29, one end of the label 25 is glued onto a vessel 37. Subsequently, the group 11 rotates on its rotary plate 19 so that the label 25 will be pressed onto the vessel group 11 with the aid of a press-on rail 39 configured e.g. as a vacuum sponge. When the label 25 has been wound once around the two vessels, a bundle 41 comprising the two vessels 11 is formed. The finished bundles 41 are then fed to a discharge belt 47 via a discharge star wheel 42 which, too, has formed thereon appropriate reception pockets 45.

Figure 2:
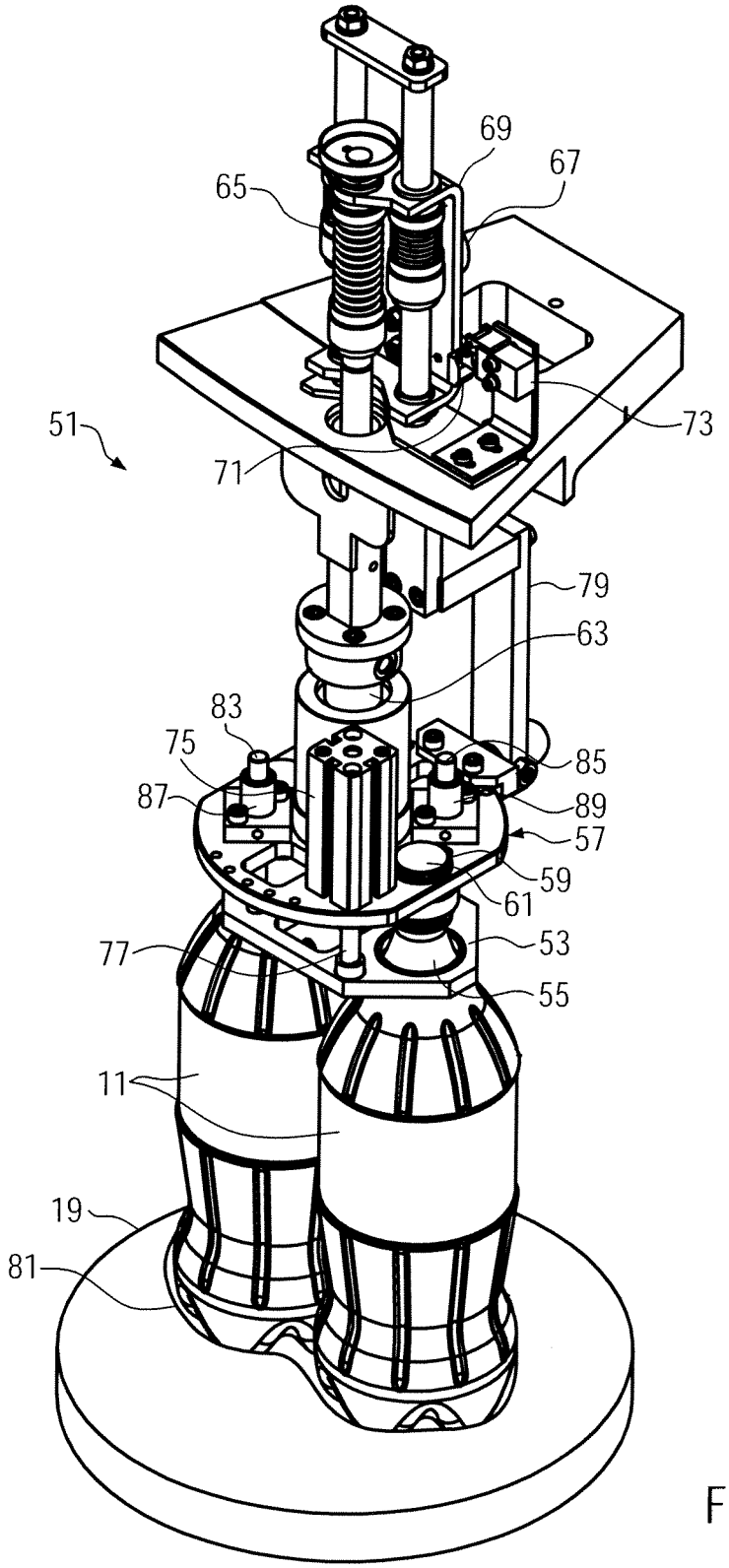
FIG. 2 shows a 3D view of a centering unit according to a first embodiment used for aligning two grouped vessels, FIG. 3 schematically shows the centering method according to a second embodiment.

For forming these bundles 41, it is extremely important that the two vessels 3 are in correct alignment with one another. To this end, the vessels 3 are clamped between a centering unit 51 and the rotary plates 19, which have already been mentioned, (cf. FIG. 2). FIG. 2 shows a first embodiment of the centering unit according to the present disclosure, which is used for aligning at least two grouped vessels 11. Elements and features with reference numerals that have already been used in FIG. 1 will not be described in detail once more hereinbelow. Reference is herewith made to the description of these elements and features.

The centering unit 51 according to the present disclosure comprises a precentering means 53 which is here implemented as a centering plate. The centering plate 53 has two vessel reception openings 55. In FIG. 2 the second opening is hidden and cannot be seen. This opening is configured such that, as can be seen in FIG. 2, e.g. a bottle neck can be passed therethrough.

Above the precentering plate 53, a final centering means 57 is arranged, said final centering means 57 being here also configured as a plate. Also the final centering means 57 comprises two openings 59 (only one of them being visible in FIG. 2) whose apertures are configured such that they accommodate and position the upper extremity 61 of the vessels 11. Since, thanks to the precentering plate 53, the vessels 11 are already in alignment with one another, the inner diameter of the opening 59 is dimensioned such that it essentially corresponds to the outer diameter of the upper extremity 61 of the vessel 11. The two vessels 11 can be precisely aligned with one another in this way.

The final centering means 57 is arranged such that it is vertically and rotationally displaceable via a rotary connection 63 and a spring system 65. The lowering and lifting movement of the final centering means 57 is accomplished with the aid of a cam guide roller 67. Due to the up and down movement of the cam guide roller 67 along a control track, which is here not shown, also a plate 69 connected to the spring system 65 is moved up and down, whereby the final centering means 57 can be moved up and down against the spring forces of the spring system 65.

It is, however, not only the final centering means 57 that can be lifted and lowered, but the precentering means 53 can be moved up and down as well. In the present embodiment, the precentering means 53 is lifted and lowered through pneumatic control. To this end, the plate 69 has provided thereon a projection 71 through which a valve 73 is activated during lifting and lowering of the plate 69 in accordance with the movement of the cam guide roller 67 along the control track. The valve 73 switches pressurized air (the connection tubes are not shown here for the sake of clarity), whereby the precentering plate 53 can be lifted or lowered via the lift cylinder rod 77 of a lift cylinder 75 (a second lift cylinder is not visible in FIG. 2 because it is arranged behind the rotary connection 63), independently of the final centering means 57.

Due to the fact that the lift cylinder 75 is arranged on the final centering means 57 in the present embodiment, the total stroke of the precentering plate 53 comprises the possible stroke of the final centering means 57 and the height of stroke of the lift cylinder 75. This is an optimum structural design, in particular in cases where the stroke of the final centering means 57 is coaxial with the stroke of the precentering means 53, as can be seen in FIG. 2.

The stabilizer 79, which is additionally arranged on the centering unit 51, only serves to stabilize the plane of the final centering means 57 during rotations.

In the present embodiment, the final centering means 57 is provided with through holes 59 for receiving the vessels therein. According to an alternative embodiment, the vessel reception openings 59 may also be implemented as blind holes.

For wrapping standard bottles, a stroke of 43 to 53 mm will normally suffice for the final centering plate 57 and a stroke of 45 to 50 mm will normally suffice for the precentering plate 53.

Also the rotary plate 19, on which the vessels 11 are positioned, is schematically shown in FIG. 2. For reliably fixing the bottle pair 11 between the rotary plate 19 and the centering unit 51, the rotary plate 19 can be provided with depressions 81 whose shape is adapted to that of the vessels.

FIG. 2 additionally shows two guide pins 83 and 85 preventing unintentional tilting of the precentering plate 53 during the lowering movement. The pins 83 and 85 are guided in sleeves 87, 89 that are secured to the final centering means 57.

Figure 3:
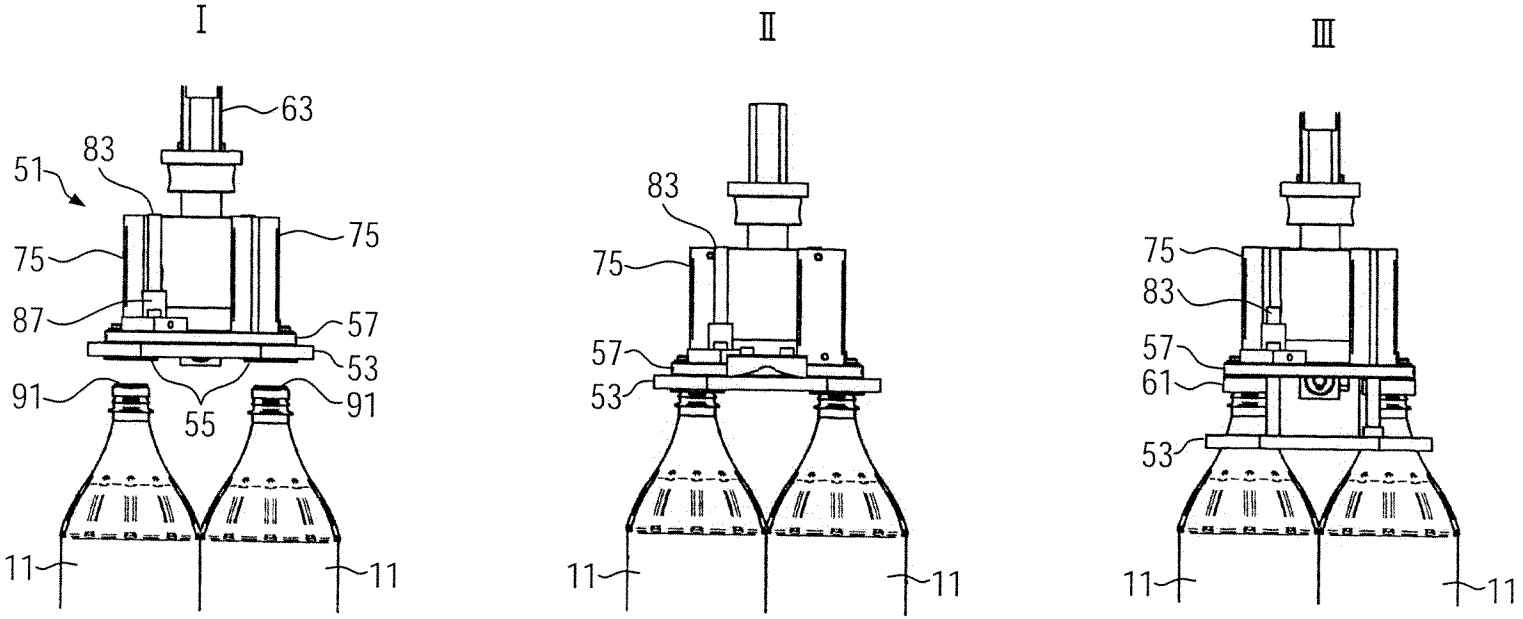

FIG. 3 schematically shows, on the basis of three cross-sectional views, a second embodiment, viz. a method for aligning at least two grouped vessels according to the disclosure. Elements and features with reference numerals that have already been used in FIGS. 1 and 2 will not be described in detail once more. Reference is herewith made to the description of these elements and features.

The three states I to III shown in FIG. 3 occur at the points shown in FIG. 1 and located between the infeed star wheel 13 and the labelling module 23 in the labelling machine 1. The three states are schematically indicated by the Roman numerals I, II, III adjacent the carousel 21.

State I: When the infeed star wheel 13 has transferred a bottle pair 11 to a rotary plate 19, a centering unit 51 according to the first embodiment of the present disclosure is positioned slightly above the upper extremities 91 of the vessels 11. In this side view, the rotary connection 63, the two lift cylinders 75 as well as a guide pin 83 in its guide sleeve 87 can be seen. In the state shown, the precentering plate 53 and the final centering plate 57 are in contact with one another.

State II: When the carousel 21 has slightly moved on (FIG. 1), the final centering plate 57 moves together with the precentering plate 53 in response to a lowering of the cam guide roller 67 along the control track in the direction of the upper extremities 91 of the bottles and arrives at state II of FIG. 3. The precentering plate 53 and the final centering plate 57 are here still in contact with one another, as can also be seen from the fact that the guide pin 83 is still flush with the upper end of the lift cylinder 75. However, other than in the case of state I, the upper extremities 91 of the vessels 11 are now positioned within the vessel reception openings 55 of the precentering plate 53.

State III: In the third state shown in FIG. 3, the projection 71 (cf. FIG. 2) on plate 69 activates the valve 73 and causes pneumatic lowering of the precentering plate 53. The bottle neck of the vessels 11 is now in contact with the inner walls of the vessel reception openings 55. In addition, the upper extremities 91 of the vessels 11 are fixed in position in the vessel reception openings 59 of the final centering plate 57. As can be seen from the figure, also the guide pin 83 has now been lowered relative to the lift cylinder 75.

Thanks to the precentering means 53 and the final centering means 57, both vessels are fixed relative to one another not only on the upper extremities 91 themselves but also further down on the bottle neck so that the whole positioning of the two vessels 11 relative to one another can be stabilized. It follows that, especially in cooperation with the depressions 81 formed in the rotary plate 19, the vessels 11 are held relative to one another at three different positions.

Figure 4:
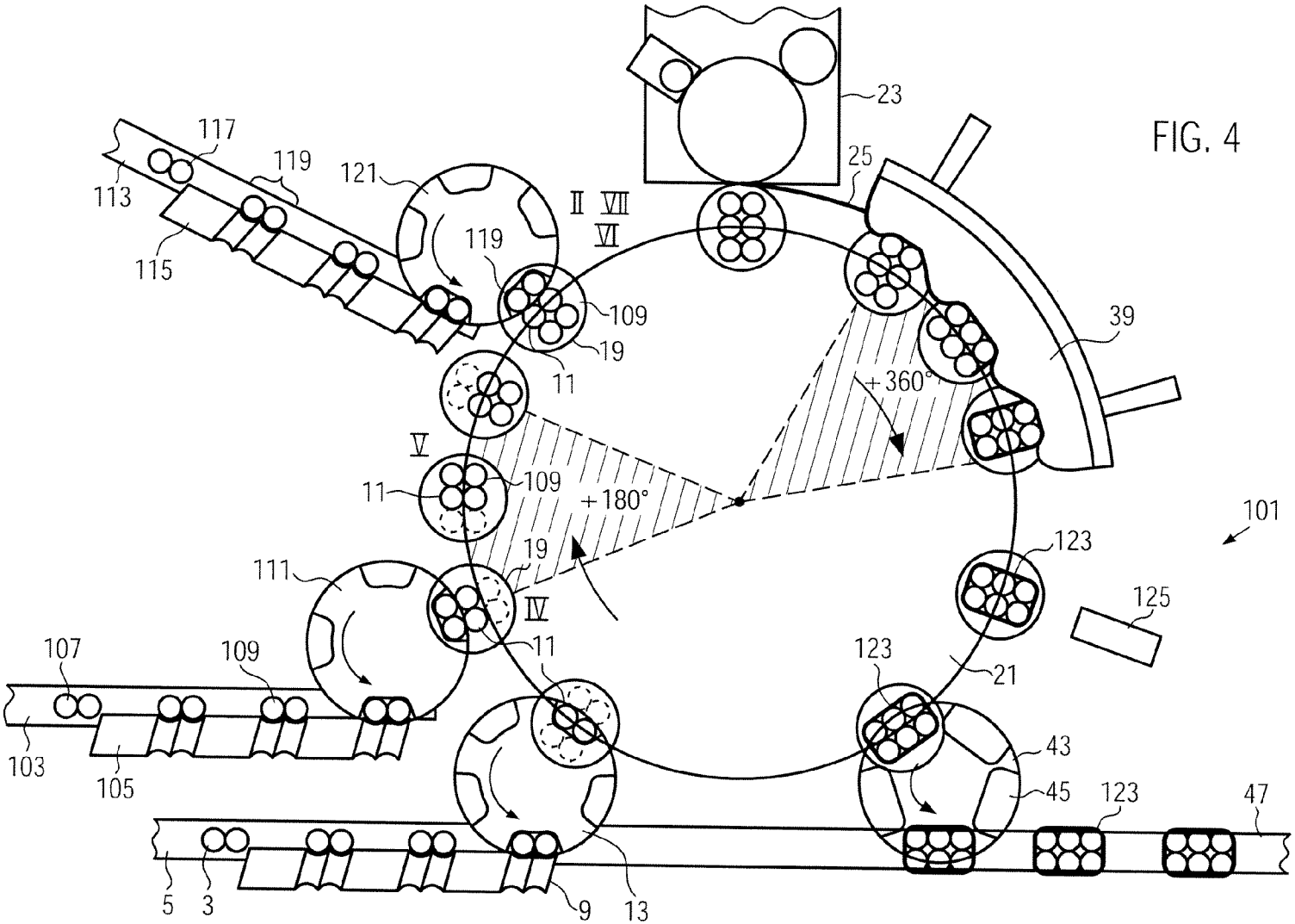
FIG. 4 shows a device for enwrapping six juxtaposed objects.

FIG. 4 shows a second machine for treating grouped vessels, in particular for wrapping them with a common label according to the present disclosure. Features with reference numerals that have already been used in FIGS. 1 to 3 will not be described in detail once more. Reference is herewith made to the above description of these features.

The difference between the machine 101 shown in FIG. 4 and the machine 1 that has been shown and described in FIG. 1 is that not only one vessel feeding device comprising an infeed star wheel 13 and an infeed worm 9 is provided at the treatment station 21, but three vessel feeding devices are provided there.

The second feeding station comprises a separate feeder 103 and an infeed worm 105 for grouping the vessels 107 in pairs, which are fed via the conveyor 103. The vessel groups 109 are then transferred via a second infeed star wheel 111 to the rotary plate 19, where the vessel pair 109 is arranged in juxtaposition with the vessel pair 11 that has already been pushed onto the rotary plate 19 by the infeed star wheel 13.

The third vessel feeding device comprises a third feeder 113 and a third infeed worm 115 for grouping in pairs 119 also the vessels 117 fed via the third feeder 113. These pairs 119 are then fed via a third infeed star wheel 121 to the rotary plate 19 which has already arranged thereon the vessel pairs 11 and 109.

As can be seen, the rotary plate 19 is rotated by 180° between the second vessel feeding device and the third vessel feeding device in this embodiment. This is schematically indicated in FIG. 3 by the cross-hatching and the value 180°.

When the three vessel pairs 109, 11 and 119 have been pushed onto the rotary plate 19, the carousel 21 rotates further and past the labelling module 23. Along the press-on rails 39, which are here a vacuum unit with special sponge contours, the three vessel pairs 109, 11 and 119 are fully wrapped with the label 25 which is then fixed by gluing. For this purpose, the rotary plate rotates once by at least 360°; also this is indicated in FIG. 3 by cross-hatching and the value 360°.

In this way, a bundle 123 is obtained, which comprises, other than in the case of the first embodiment, not two but six vessels (sixpack).

As a variant of the machine according to FIG. 1, the machine according to FIG. 3 additionally comprises a label inspection station 125, e.g. a camera or a sensor.

Subsequently, the bundle 123 is, again with the aid of a discharge star wheel 43 with appropriate reception pockets 45, transported to the discharge conveyor 47.

Due to the fact that three vessel feeding stations are provided, different vessels and/or different products can be combined so as to form one bundle 123. In the present case, respective vessel pairs 11, 109, 119 were pushed onto the rotary plate, but it would also be possible to push on a larger or a smaller number of vessels at each vessel feeding station, independently of one another.

Figure 5:
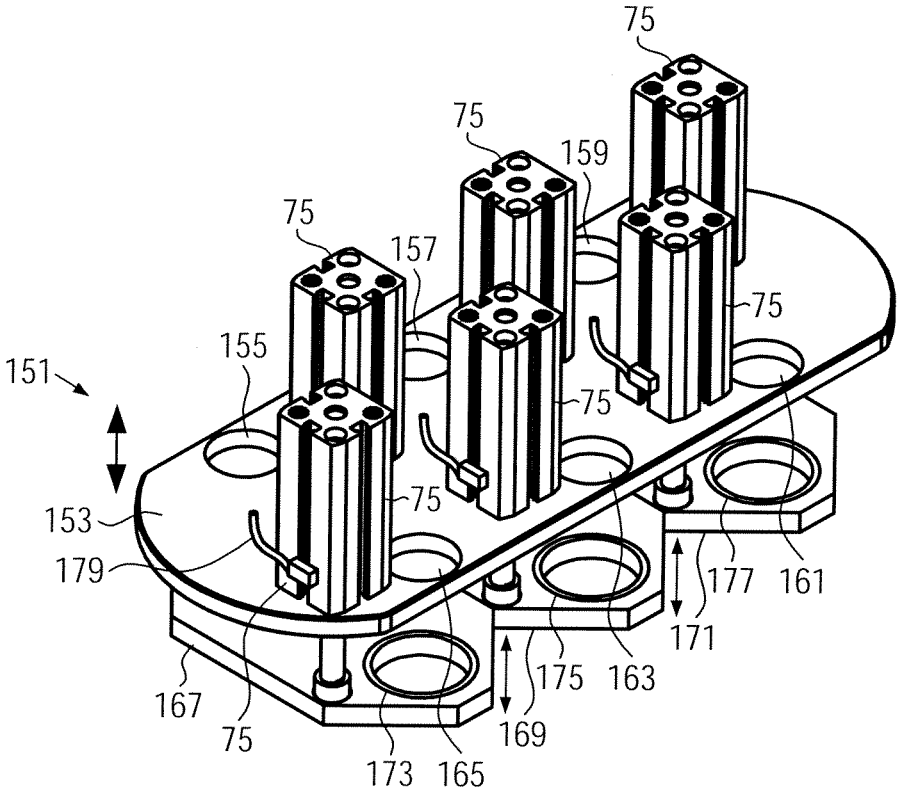
FIG. 5 schematically shows a part of a centering unit for aligning six grouped vessels in accordance with a third embodiment of the present disclosure, and FIG. 6 schematically shows the steps for centering these grouped vessels in accordance with a fourth embodiment of the present disclosure.

FIG. 5 shows schematically a third embodiment of a part of a centering unit 151 for centering grouped vessels according to the present disclosure. The figure shows a detail of a centering unit which can be used in the machine shown in FIG. 4. Features with reference numerals that have already been used in one of the FIGS. 1 to 4 will not be described in detail once more. Reference is herewith made to the description of these features.

In FIG. 5 only the lower part of a centering unit 151 is shown. The final centering means 153, which are here again a plate and which are provided with six vessel reception openings 155, 157, 159, 161, 163, 165, can be seen in this figure. Below the final centering means 153 three subcentering means are disposed, which are again defined by plates 167, 169 and 171 and which are arranged independently of one another. These plates 167, 169 and 171 define the precentering means 53. Each of these subcentering means 167, 169, 171 is provided with two vessel reception openings 173, 175 and 177 (the respective second opening per centering means is not visible in this view).

FIG. 5 also shows the lift cylinders 75 on the final centering plate 153; in the case of the front lift cylinders 75, also the pneumatic connection tubes 179 are schematically shown. In this representation, the guide pins are not shown. Just as in the first embodiment, these guide pins are, however, provided.

The final centering plate 153 is again arranged on a rotary connection 63 and a spring system 65 in the carousel such that it is vertically adjustable (represented by the double arrow on the left side) via a cam guide roller 67.

Other than in the case of the first embodiment, where the precentering plate 53 could be lowered as a whole, this embodiment comprises three subcentering means 167, 169 and 171 which are adapted to be lifted and lowered independently of one another through the lift cylinders 75. The fact that the subcentering means can be lifted and lowered independently of one another is indicated by the double arrows shown on the lower right in the case of each subcentering means 167, 169, 171.

In correspondence with the first embodiment, the lifting and lowering movements are controlled pneumatically, the respective control air required being provided via three independent valves. These valves can be controlled independently of one another, e.g. via the cam guide roller.

As for the rest, the final centering plate 153 as well as the subcentering means 167, 169 and 171 of the precentering means correspond to the final centering means 57 and the precentering means 53 of the first embodiment.

Figure 6:
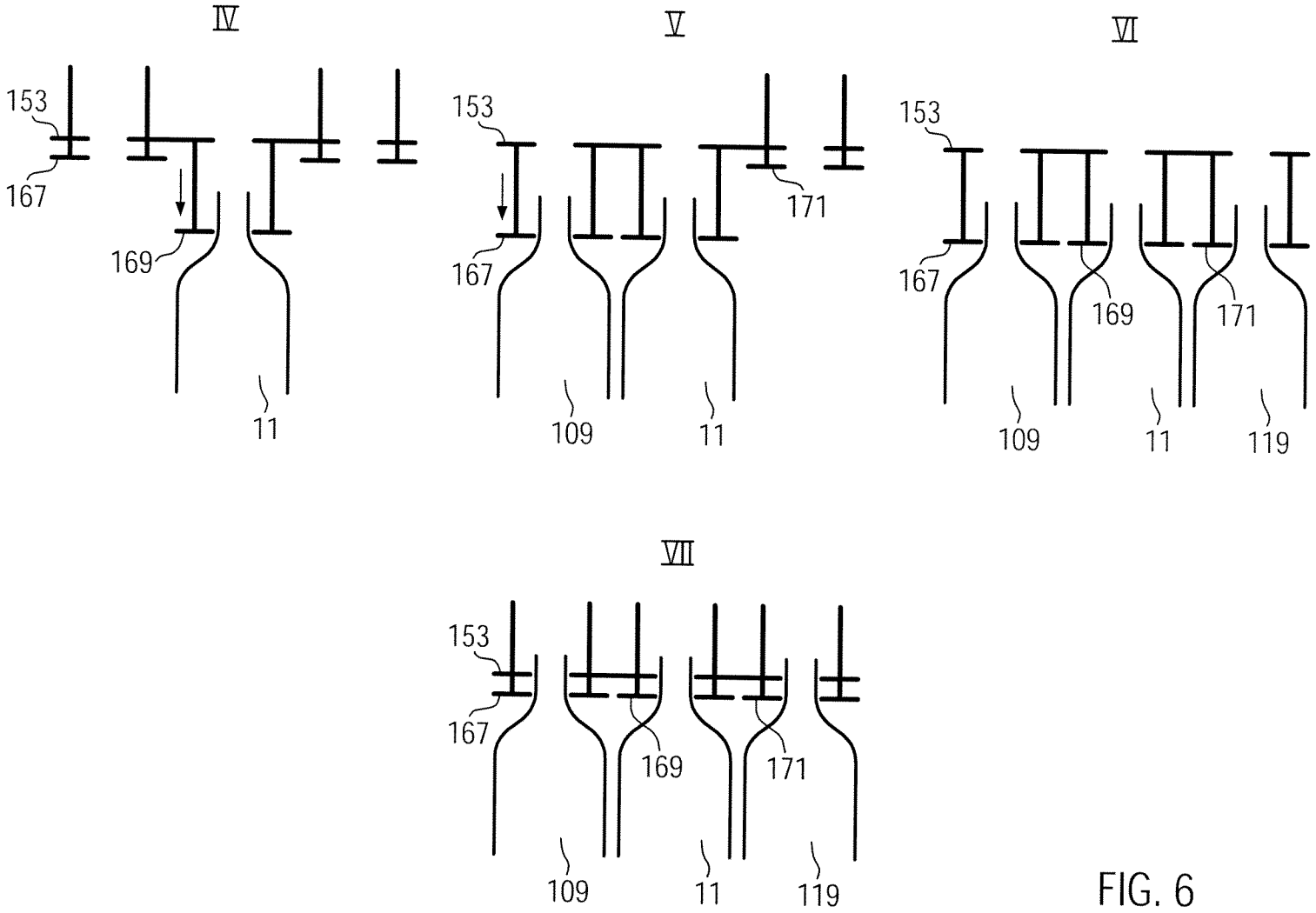

The centering unit 151 is used in a machine for treating grouped vessels of the type shown in FIG. 3. FIG. 6 shows a schematic representation of a fourth embodiment of the present disclosure, viz. a second embodiment of the grouped-vessel centering method according to the present disclosure, and the use of the centering unit 151 at four different locations IV, V, VI and VII of the machine 101, said locations being indicated in FIG. 4. Features with reference numerals that have already been used in one of the FIGS. 1 to 5 will not be described in detail once more. Reference is herewith made to the description of these features.

State IV: When the first group of vessels 11 has been pushed onto the rotary plate 19, only the central precentering plate 169 is first lowered so as to align the vessels of vessel group 11 relative to one another. The precentering plate 167 and the precentering plate 171 are at this time still in contact with the final centering plate 153.

State V: When the second vessel group 109 has been pushed onto the rotary plate 19, also the left precentering plate 167 is lowered relative to the final centering plate 153 so as to align, on the one hand, the vessels of said vessel group 109 relative to one another and, on the other hand, this vessel group 109 also relative to the first group 11. The third subcentering plate 171 remains still in contact with the final centering plate 153.

State VI: When the third vessel group 119 has been pushed onto the rotary plate 19, also the third subcentering plate 171 is lowered. Now, the three precentering plates 167, 169 and 171 have all been lowered, which means that also the vessels of the third group 119 are now aligned relative to one another and that, in addition, also the three vessel groups 11, 109 and 119 are aligned relative to one another.

In the next state VII, a short distance before the labelling station 23, also the final centering plate 153 is lowered so as to receive the extremities 91 of the vessels in the respective vessel reception openings 155 to 165. It follows that, together with the depressions provided in the rotary plate 19, the six vessels are held at three different points so that a stable positioning of the sixpack is accomplished. The lowering of the final centering plate 153 can simultaneously lead to a further lowering of the three precentering plates 167, 169 and 171, or the two centering means—the final centering means and the precentering means—reapproach one another.

Finally, it should be pointed out that the various states are only shown schematically in FIG. 6 and that the actual dimensions may deviate from that which is shown. In particular, the vessels abut on one another in their belly regions, as can be seen in FIG. 2.

Thanks to the centering unit of the third embodiment, a flexible machine for treating grouped vessels, in particular for wrapping a label around vessels, can be provided. The machine simultaneously guarantees improved centering due to the fact that precentering means are provided at one point of the vessels and final centering means are provided at another point of the vessels (the upper extremity).

The invention claimed is:

1. A machine for treating at least two grouped vessels comprising a treatment station, at least one rotary plate for receiving thereon a plurality of vessels and at least one centering unit associated with a respective rotary plate for aligning at least two grouped vessels relative to one another, comprising a liftable and lowerable precentering means and a liftable and lowerable final centering means, the precentering means and the final centering means being implemented such that they can be lifted and lowered independently of one another and wherein the precentering means is implemented such that it can be lifted and lowered via a pneumatic control and wherein the total stroke of the precentering means comprises at least partially the stroke of the final centering means.

2. The machine according to claim 1, wherein the precentering means comprises a plurality of subcentering means that can be lifted and lowered individually.

3. The machine according to claim 1, wherein the precentering means are implemented such that they can be lifted and lowered via a pneumatic control.

4. The machine according to claim 3, wherein the subcentering means are each provided with at least one vessel reception opening.

5. The machine according to claim 4, wherein a lifting path and a lowering path of the vessel reception openings of the precentering means and of the final centering means are formed coaxially with one another.

6. The machine according to claim 4, wherein the precentering means comprises two or three subcentering means and wherein each subcentering means is provided with two vessel reception openings.

7. The machine according to claim 6, comprising at least one vessel feeding device for providing the vessels on the at least one rotary plate in the treatment station.

8. The machine according to claim 7, wherein a subcentering means of the at least one centering unit is associated with a respective vessel feeding device so that the vessels that can be provided by the vessel feeding device can be precentered by the subcentering means.

9. The machine according to claim 7, wherein at least one vessel feeding device includes a grouping device for providing vessel groups in predetermined spaced relationship with one another.

10. The machine according to claim 9, wherein the vessel groups comprise vessel pairs.

11. The machine according to claim 7, wherein the vessel feeding device comprises an infeed star wheel and an infeed worm.

12. The machine according to claim 7, wherein the treatment station is configured as a carousel.

13. The machine according to claim 7, and comprising two or three vessel feeding devices.

14. A method of aligning at least two grouped vessels, in a machine for treating vessels having a treatment station, at least one rotary plate for receiving thereon a plurality of vessels and at least one centering unit associated with a respective rotary plate for aligning at least two grouped vessels relative to one another, comprising a liftable and lowerable precentering means and a liftable and lowerable final centering means, the method comprising:

a) precentering the grouped vessels with a liftable and lowerable precentering means, and b) final centering of the precentered vessels with a liftable and lowerable final centering means, wherein the precentering means and the final centering means are implemented such that they can be lifted and lowered independently of one another, the precentering means being lifted and lowered via a pneumatic control and wherein the total stroke of the precentering means comprises at least partially the stroke of the final centering means.

15. The method according to claim 14, wherein the vessels are provided by at least one vessel feeding device(s).

16. The method according to claim 15, wherein the vessels are provided in pairs, and by two or three vessel feeding devices.

17. The method according to claim 14, wherein the precentering means comprises at least two subcentering means and wherein steps a) and b) comprise at least the following steps:

a1) precentering a first vessel group by lowering a first subcentering means, then a2) precentering a second vessel group by lowering a second subcentering means, and then b1) final centering of the precentered vessels by lowering the final centering means.

18. The method according to claim 14, wherein the machine for treating vessels is a machine for wrapping the grouped vessels with a common label.

19. A machine for treating at least two grouped vessels comprising a treatment station, at least one rotary plate for receiving thereon a plurality of vessels and at least one centering unit associated with a respective rotary plate for aligning at least two grouped vessels relative to one another, comprising a liftable and lowerable precentering means and a liftable and lowerable final centering means, the precentering means and the final centering means being implemented such that they can be lifted and lowered independently of one another, and wherein the precentering means is implemented such that it can be lifted and lowered via a pneumatic control and wherein the final centering means is moved up and down along a control track.

* * * * *